United States Patent [19]

Bonomi

[11] 4,409,741

[45] Oct. 18, 1983

[54] CONVEYOR DEVICE FOR TRANSFERRING FRESHLY PRINTED SHEETS

[75] Inventor: Antonio Bonomi, Lausanne, Switzerland

[73] Assignee: De La Rue Giori S.A., Switzerland

[21] Appl. No.: 259,668

[22] Filed: May 1, 1981

[30] Foreign Application Priority Data

May 5, 1980 [CH] Switzerland ..... 3472/80

[51] Int. Cl.[3] ..... F26B 13/12; B65H 29/04

[52] U.S. Cl. ..... 34/162; 101/232; 101/416 A; 198/627; 198/653; 271/182; 271/204

[58] Field of Search ..... 271/204, 206, 182, 277, 271/183; 34/162; 101/416 A, 410, 232; 198/627, 650, 653, 654, 696, 479; 38/143

[56] References Cited

U.S. PATENT DOCUMENTS

| | | | |
|---|---|---|---|
| 3,215,418 | 11/1965 | Fannon | 101/416 A X |
| 3,269,524 | 8/1966 | Canfield | 198/654 X |
| 3,413,732 | 12/1968 | Koch et al. | 271/206 X |
| 3,430,946 | 3/1969 | Siebke | 271/277 |
| 3,841,625 | 10/1974 | Carricato | 271/206 X |
| 3,991,484 | 11/1976 | Lamb et al. | 34/162 |
| 4,225,129 | 9/1980 | Zimmermann et al. | 271/204 |

*Primary Examiner*—Bruce H. Stoner, Jr.
*Attorney, Agent, or Firm*—Kane, Dalsimer, Kane, Sullivan and Kurucz

[57] ABSTRACT

This conveyor device for transferring freshly printed sheets from a printing machine to a stack or to another printing machine, comprises a first chain clips system movable continuously and adapted to hold with its clips the leading edge of the sheet. This first system comprises a rectilinear path section along which a second system of chain clips is provided, the clips of this second system, disposed in the same transport plane as those of the first system, being adapted to grip the trailing edge of each sheet as it penetrates this section, and to subsequently stretch the sheet tautly by accomplishing a slight backward movement in relation to the clips of the first system, and to hold the sheet taut throughout its travel through this section. This device is applicable notably to a drying station of a machine for printing sheets according to the direct plate printing process and is also adapted to turn the sheets.

12 Claims, 9 Drawing Figures

CONVEYOR DEVICE FOR TRANSFERRING FRESHLY PRINTED SHEETS

BACKGROUND OF THE INVENTION

This invention relates to conveyor means for transferring freshly printed sheets from a printing machine to an output stack or to another printing machine, and has specific reference to a device of this kind comprising a chain clips system moving continously and wherein the clips are adapted to grip and hold the leading edge of the printed sheets, this system comprising a predetermined rectilinear course area.

THE PRIOR ART

Chain clips systems have been widely used for conveying freshly printed sheets, but up to now the sheets were held only by clips gripping their leading edge in such a way that, considering their relatively high travel speed, the sheets are not really stable but "float" slightly. Now, there are instances wherein it is particularly desirable that at least during one portion of their course the sheets be conveyed in a perfectly stretched or flat condition. This requirement is particularly important when drying freshly printed sheets, notably in direct plate printing, in order to preserve accurately a predetermined distance with respect to a given component element of the conveyor chain.

In fact, whereas in coil machines the tape can easily be kept in a stretched or taut condition during its travel past the heat source, in the case of separate sheets held by a chain clips system it is more complicated to keep the sheets at a constant distance from the heat source in order to achieve a regular drying thereof, a factor particularly important for preserving the final quality of the printed sheets, for the use of a special, high-viscosity ink as currently required in direct plate printing requires the application of relatively intense heat. Up to now, this requirement was met by using a drum over which the sheets, held by clips gripping their leading edges, are caused to pass. However, it appeared that on the one hand it was not quite satisfactory to impart a curved geometry to the sheets during the drying thereof, for when subsequently stacked they did not lie perfectly flat and their corners tended to curl up, and on the other hand, considering the intense heating necessary for properly drying the sheets in a relatively short time, the drum surface had to be cooled.

Now this cooling is both complicated and expensive. Besides, it is also necessary in the specific case when a rectilinear section of the sheet travels on a support consisting of bearing plates or rods on which the sheet is caused to slide, since these plates or rods must also be cooled. Devices of this character are disclosed for example in the Swiss Pat. No. 480,175 and in the French Pat. No. 1,336,766. Another drawback of this known system is that, due to their high linear speed, the sheets "float" more or less in the air and their distance to the heat source varies, thus preventing or impairing a regular drying action.

Therefore, notwithstanding the improvements obtained during the last few years in the field of direct plate printing, and so far as the Applicant is aware, the problem of drying the printed sheets rapidly and accurately by using a relatively strong external heat source has not been solved satisfactorily.

SUMMARY OF THE INVENTION

It is therefore the primary object of the present invention to provide a conveyor device in which the printed sheet to be dried can be held in a well-defined position during a predetermined course. This device being applicable inter alia to the intense drying of such sheets when it is desired to maintain at a uniform value the distance from each sheet to the heat source during the passage time, while providing a satisfactory solution to the sheet-cooling problem.

For this purpose, the system of the present invention is characterized in that a second chain-type clip system is provided of which the clips are disposed along the rectilinear section of the conveyor, substantially in coplanar relationship with the clips of the first chain-type clip system, the clips of the second series being adapted to grip the trailing edge of each sheet as the latter enters said section, in order to stretch same tautly by performing a small backward movement with respect to the clips of the first series holding the leading edge of said sheet, and to keep the sheet taut throughout its travel through said section, and that all the clips of a series assigned to a given sheet are carried by a support mounted to the chains of the second series of clips so that they can be moved longitudinally with respect to said chains and shifted by a control device from a first position corresponding to the position in which the sheet is stretched to a second position corresponding to the position in which the sheet is slackened.

By using this arrangement for drying freshly printed sheets, a device is obtained which can be constructed very easily since it comprises the same component elements as the first chain-type clip system, this device permitting on the one hand the uniform and regular drying of the sheets and on the other hand and for the first time the clearing of the drying area in which the source is operative from any stationary means for supporting and guiding the sheets, since only the clips secured to the chains travel through this area.

Since the latest machines having a capacity of 8,000 sheets per hour (considering printed sheets having a minimum length of 350 mm and a maximum length of 590 mm, and the gap between successive sheets) a maximum linear speed of about 1.4 meter per second is attained; in a still more recent machine for formats having a minimum length of 400 mm and a maximum length of about 820 mm, the maximum linear speed is about 1.9 m/s.

Moreover, with the drying device of this invention it is possible to dispense with the hitherto generally necessary inlay consisting in the interposition of white sheets between adjacent printed sheets to prevent the latter from adhering to each other. This inlay increased the intricacy of the machine and of course the printing cost.

With the system of the present invention it is also possible to set the second series of clips with respect to the first series in order to adapt the distance between the clips of the first series and those of the second series to the sheet length.

Of course, the principle of keeping the sheet stretched tautly by using a second series of clips gripping the trailing edge of the sheet should not be construed as being strictly limited to the conveying of freshly printed sheets, since it also applicable to other operations, such as turning the sheets. In this case, it is the clips of the first series that are opened to release the leading edge of the sheet, and through a suitable curvature of the second series and tipping of the clips of this second series the trailing edge of the sheet becomes the leading edge.

The invention will now be described with reference to the accompanying drawings.

THE DRAWINGS

FIG. 1 is a fragmentary diagrammatic general view of the conveyor system showing the drying area or section thereof;

FIG. 1*a* is a fragmentary diagrammatic view showing an alternative embodiment;

DESCRIPTION OF THE PREFERRED EMBODIMENT

Figures 1, 1A:
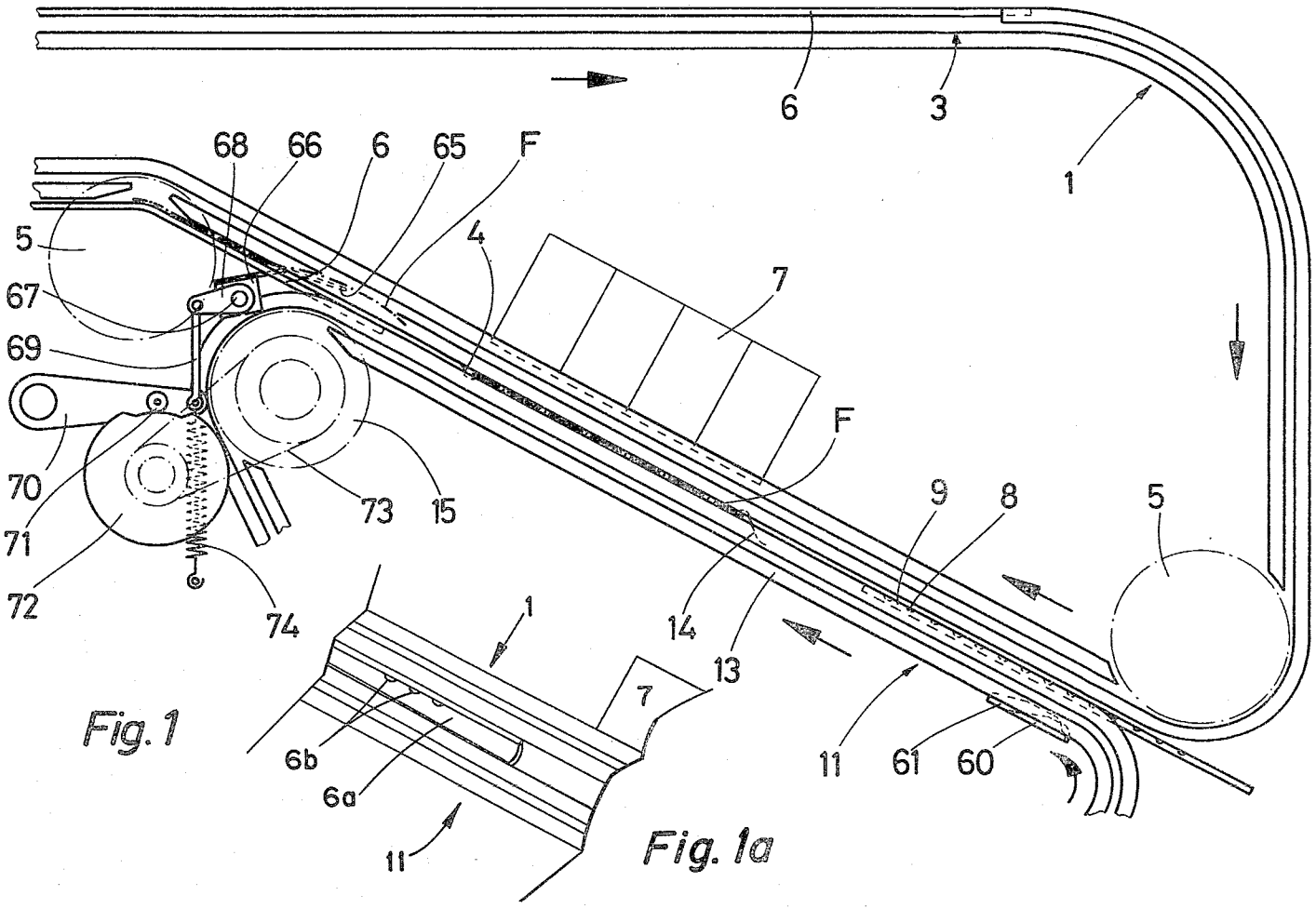
Figure 2:
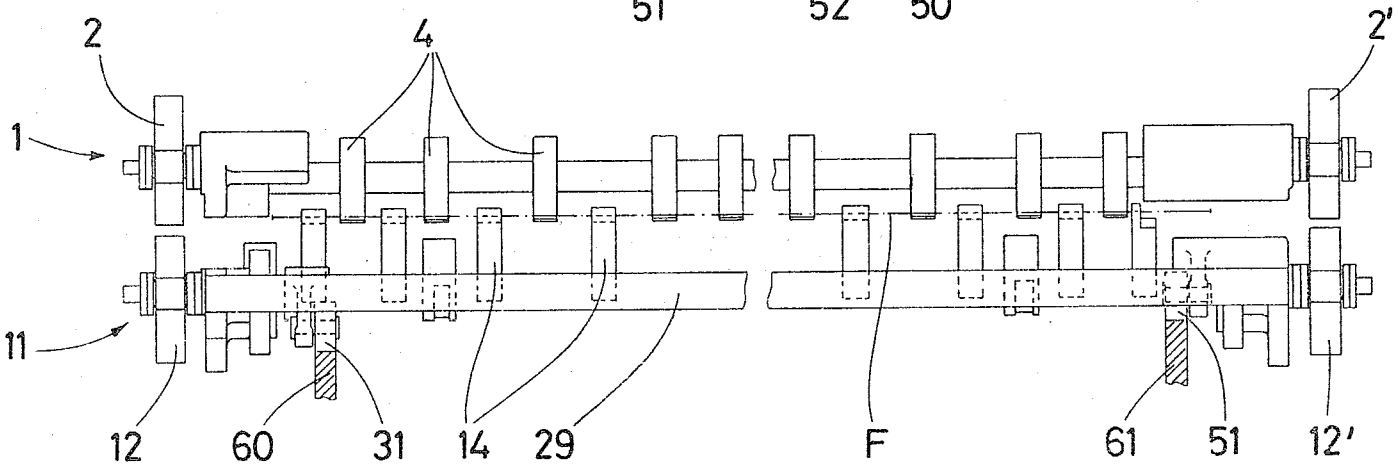
FIG. 2 is a diagrammatic side elevational view showing the two series of chain clips as seen at the level of a series of clips.

The conveyor device according to this invention, as illustrated diagrammatically in FIGS. 1 and 2, is intended for drying freshly printed sheets and comprises a first chain clips system 1 consisting of a pair of parallel endless chains 2,2' guided by rails 3 and driven by means of sprocket wheels 5 of which at least one wheel is driven from the motor of the machine (not shown). In FIG. 1 only the drying section or area of the machine is shown, this first chain clips system 1 constituting in fact a closed loop or endless structure of a type well known per se. This first system 1 drives the clips 4 disposed side by side on a common shaft and adapted to grip the leading edge of the sheet F to be conveyed.

This system 1 will thus carry along the freshly printed sheets F from a direct plate printing machine (not shown) so that the sheets move past the dying device 7 proper, and are then delivered to a stacking device or another printing device disposed at the output end of the system, for example for performing another impression on the same face. Considering FIG. 1, will be seen that the freshly printed face of the sheet is directed inwardly of the loop formed by the first chain clips system. Furthermore, throughout their travel along this first chain clips system the sheets are supported or guided by means of parallel rods 6 discontinued along the area occupied by the dying device 7. This drying device 7 is disposed on the rectilinear inclined section of the path or course followed by the sheets, as shown in FIG. 1, and comprises for example one or a plurality of ultraviolet lamps. Of course, a different heat source may be used, for example infrared lamps, gas burners of any other suitable and known means.

A second chain clips system 11 is disposed beneath the rectilinear inclined section of the first system 1, and this second system 11 also comprises a pair of parallel endless chains 12,12' carrying on their outer side, in the known fashion, laterally projecting studs 16,16' guided by rails 13, these chains being driven by sprockets 15 in synchronism with, and at the same speed as, the sprocket 5 of the first system 1; other series of clips 14 are mounted on shaft connected to these chains 12,12'.

In the area comprising the heating section the second system 11 of chain clips is so disposed that the clips 14 thereof are substantially coplanar with the operative portion of the clips 4 of the first system 1, as illustrated in FIG. 2 showing diagrammatically in section a sheet F. Moreover, this area, as already mentioned hereinabove, is free of any supporting rods 6, so that the system is clear of any stationary bearing members for supporting the sheets. Therefore, the sheets F are simply suspended between the clips 4 of the first system which grip the leading edge of the sheet and the clips 14 of the second system which grip the trailing edge thereof, as will be explained hereinafter. In fact, clips 14 of the second system recede slightly with respect to chains 12, 12' and clips of the first system after gripping sheet F. Thus, the sheet F is stretched tautly between the clips 4 and 14 during its travel through the drying area, i.e. past the heat source 7; then, when the sheet F has completed its travel through the drying area, the clips 14 are opened to release the trailing edge and the sheet continues its course since its leading edge is still gripped by the clips 4 of the first system.

To operate the clips 14 in the manner set forth hereinabove, the second system is constructed as described hereinbelow and illustrated in FIGS. 3,4 and 5 of the drawings.

Secured by means of studs 21,22 to the inner face of the pair of parallel chains 12,12' are the side members 23 of a frame structure 20. As shown in FIG. 3, stud 22 engages in the known fashion an elongated hole 62 formed through the relevant side member 23 in order to afford the play necessary for passing over the curved sections of the chain path.

The frame structure 20 is completed by a pair of cross members 26,27 interconnecting the two side members 23. Of course, these two side members 23 are symmetrical and providing with a pair of inner projections 24,25 adapted to guide a support 40 on which the clips 14 are mounted, this support being mounted in turn for longitudinal movement with respect to the frame structure 20 and consequently to the chain 12,12'.

Figure 4:
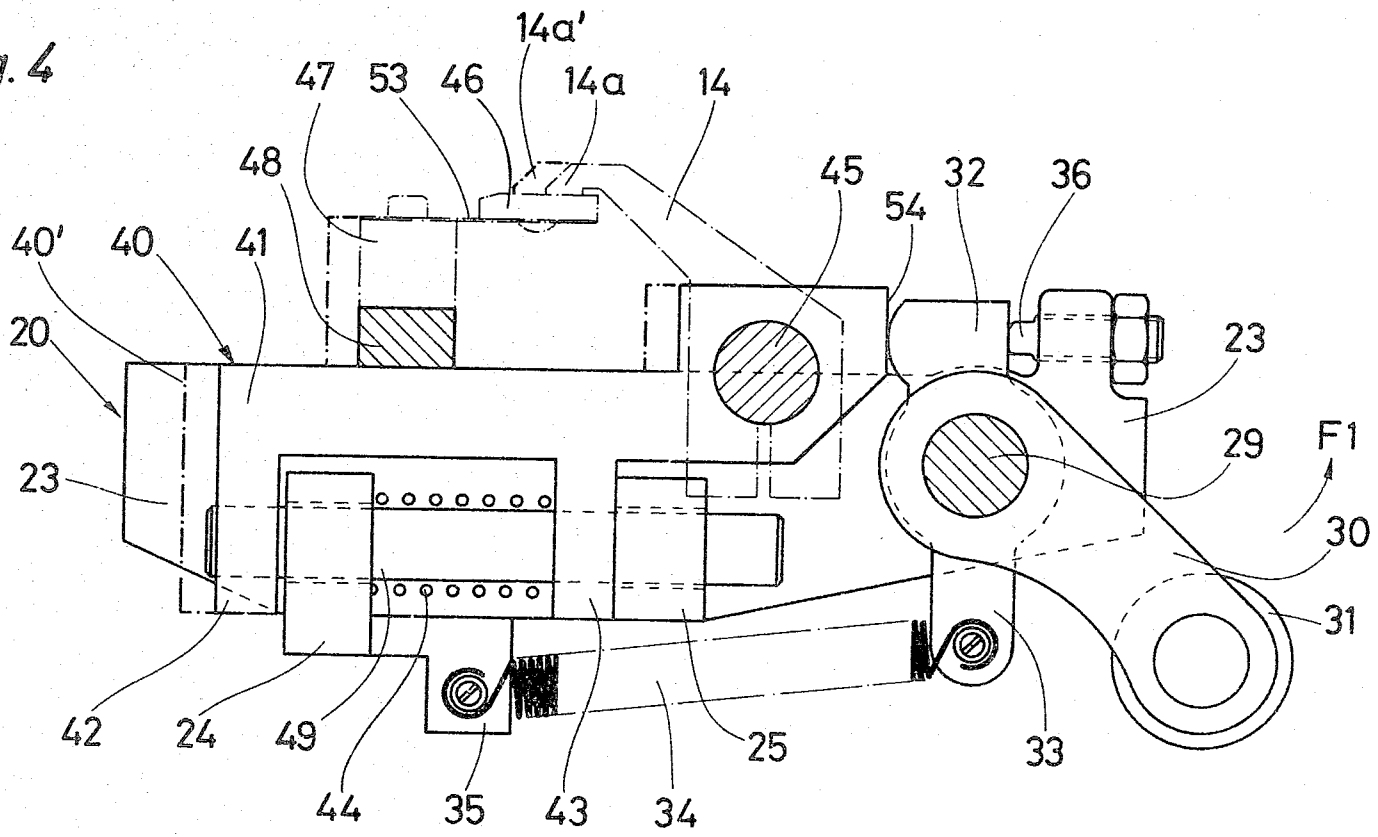
FIG. 4 is a section taken along the line IV—IV of FIG. 3, with a clip shown in dot and dash lines.

The side walls of this support 40 constitute symmetrical slide members 41 each provided, as shown in FIG. 4, with a pair of depending projections 42,43 cooperating with the aforesaid inner projections 24,25 of the corresponding member 23, with the depending projection 43 disposed between the pair of inner projections 24,25 and the other depending projection 42 disposed externally of this assembly. A guide rod 49 extends freely through aligned bores formed in the inner projections 24,25. In its normal or inoperative position the support 40 is urged by a compression spring 44 to the position shown in thick lines in FIG. 4, i.e. backwards with respect to the normal direction of travel of the chains.

The rear portion of each slide member 41, on either side of support 40, constitutes a projection 54 adapted to cooperate with one push-arm 32 of a two-armed rocker fulcrumed to a shaft 29 supported by bearings 28 secured to the side members 23 of frame structure 20. One end of shaft 29, i.e. the end adjacent the left-hand portion of the system as seen in FIGS. 2 and 3, is rigid with a control lever 30 having mounted for loose rotation on its opposite or outer end a roller follower 31 adapted to engage a cam to be described presently.

The other arm 33 of the rocker is attached to one end of a tension spring 34 having its opposite end anchored to a projecting portion 35 of the relevant side member 23 of frame structure 20. Thus, the spring 34 constantly urges the push-arm 32 to its inoperative position for engagement with an adjustable bolt 36 secured to said side member 23.

Figure 5:
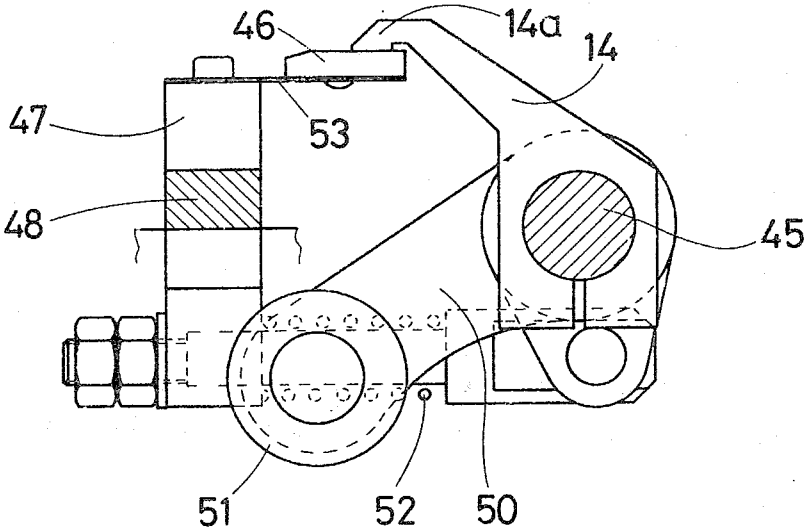
FIG. 5 is a fragmentary section taken along the line V—V of FIG. 3.

Formed in said support 40 is a bore engaged by a transverse shaft 45 along which a series of clips 14 each provided with a finger 14*a* are secured in the known fashion; this shaft 45 further comprises on one side, as illustrated in FIG. 5, a control lever 50 carrying a presser roller 51 for opening the clips 14 when the shaft 45 is rotated against the antagonistic force of a return spring 52 mounted on the relevant support 40.

Moreover, the support 40 carries between its side walls 41 a transverse bar 48 to which a series of blocks 47 are secured, each block 47 having secured to its top one end of a spring blade 53 provided at its opposite end with a stop member 46 constituting the fixed portion of the clip against which the movable finger 14*a* of the clip is pressed by spring 52, in the closed clip position.

When the control lever 30 is rotated in the direction of arrow F1 (FIG. 4) the push-arms 32 are also rotated and cause the projections 54 and therefore the slide members 41 solid therewith to move forwards, i.e. in the normal direction of travel of the conveyor, whereby the support 40, clips 14 and stop members 46 are moved in the same direction with respect to the frame structure 20, consequently with respect to the endless chains 12,12' to which this frame structure 20 is attached; this position is shown in broken lines in FIG. 4 illustrating diagrammatically only the essential component elements of the system, i.e. the support 40 and the clip, at 40' and 14'*a*. This movement takes place against the force of return springs 44 and 34. When the control lever 30 is released, support 40 and lever 30 are returned to their inoperative position by these springs.

Figure 3:
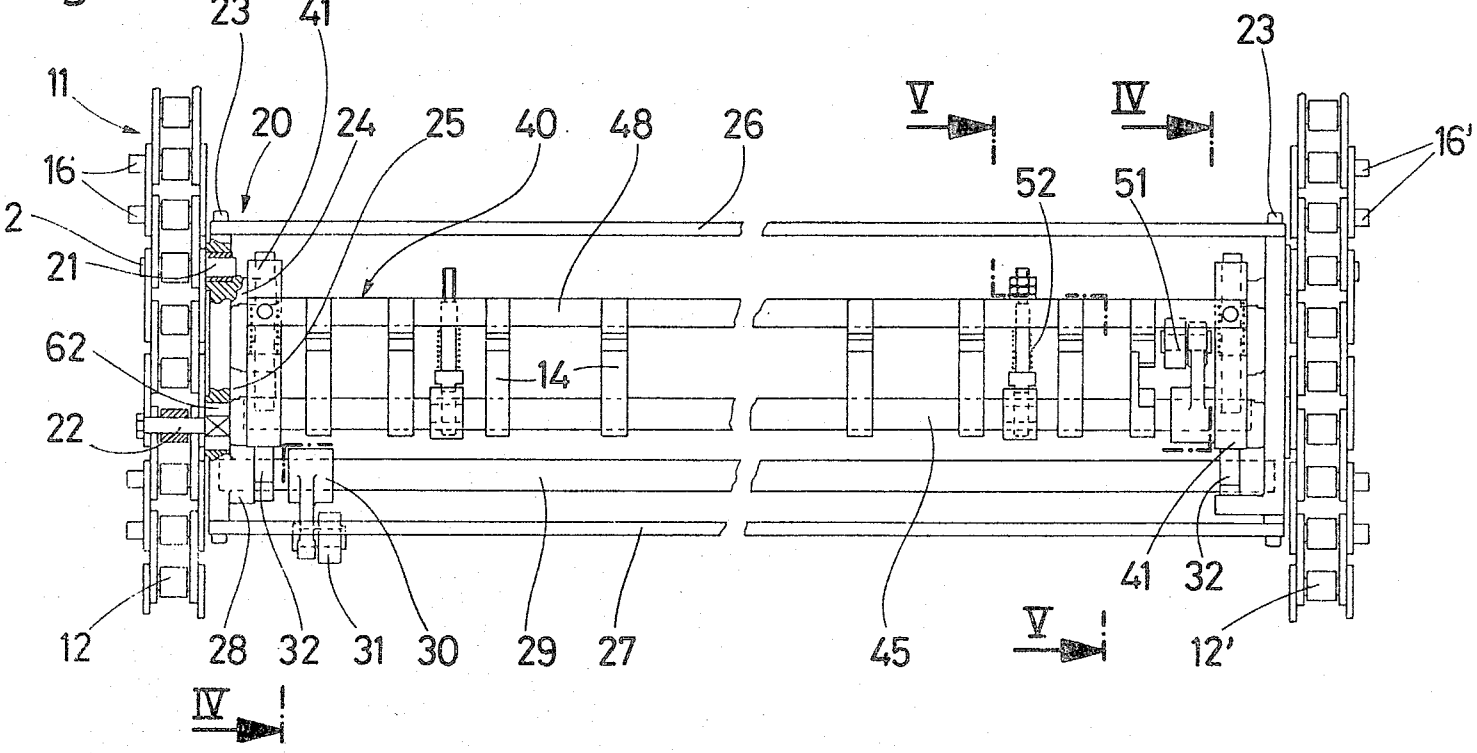
FIG. 3 is a plane view from above of the second chain clips system alone, taken at the level of a series of clips.

As clearly shown in FIGS. 2 and 3, the roller follower 31 is disposed on one side of the frame structure 20, and the other roller follower 51 controlling the opening of clips 14 is disposed on the opposite side of the frame structure. These two roller followers 31,51 cooperate with cams 60 and 61, respectively, secured in a fixed position to the frame of the conveyor device; thus, in the known fashion, when the roller followers driven by the chains engage said cams, they are actuated to produce the action described hereinabove.

Figure 6:
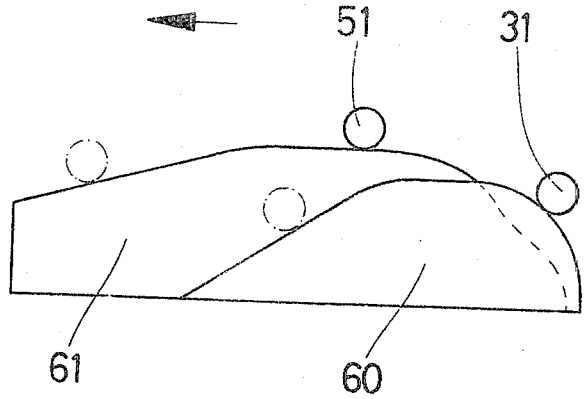
FIG. 6 is a side elevational view showing the control cams and the roller position at the beginning of the clip opening movement and during the closing thereof.

More particularly, the device of this invention operates as follows:

The sheet F travels on the first system 1 and has its leading edge held by the clips 4 while the sheet slides on the supporting rods 6. When the trailing edge of the sheet engages the rectilinear inclined section where the control cam 60 is located (see FIGS. 1 and 6), the mechanism controlling the clips 14 is actuated and operates as follows: firstly, cam 61 engages roller follower 51 and causes the clips 14 to rotate about shaft 45 and be opened against the force of spring 52; immediately thereafter, the other cam 60 engages the other roller follower 31 and, as described in the foregoing, this causes the support 40 to move forwards, whereby the trailing edge of the sheet is positioned between the open clips 14 and the stop member 46; subsequently, due to the particular contour of cam 61, the clips are closed again so as to grip the trailing edge of the sheet, also as a consequence of the particular contour of cam 61, and the roller follower 31 is released and the support 40 resumes its inoperative position in which the sheet is stretched tautly between the two sets of clips 4 and 14. The spring blades 53 carrying the stop members 46 impart a sufficient flexibility to the assembly during the sheet gripping step, thus avoiding any possibility of damaging the trailing edge of the sheet. Of course, the distance between the set of clips 14 of the second system and the corresponding set of clips 4 of the first system is consistent with the sheet length measured in the direction of travel and such than when the support 40 is in its inoperative position the sheet F is stretched whereas in the forward position of said support the sheet is slackened.

During its passage past the ultraviolet or similar drying device 7 the sheet F is so tensioned that its distance from the heat source remain constant throughout this passage so that the sheet is heated uniformly and regularly; in addition, since no other support means are present in this drying area, due notably to the fact that the rods 6 are discontinued therealong, the heat source will not heat any stationary metal element and therefore no cooling system is required, contrasted with hitherto known arrangements of this character. At the outlet end of this drying area the first system 1 is again provided with supporting rods 6 for supporting the sheet F as soon as the latter has cleared the heating or drying area completely, another cam (not shown) being provided thereat for opening the clips 14 and thus release the trailing edge of the sheet.

In order to positively assure that when the trailing edge of sheet F is about to be gripped by the clips 14 the rear portion of the sheet is properly held flat against the supporting rods, hollow supporting rods 9 having orifices 8 (FIG. 1) are provided and connected to suction means, whereby the trailing edge of the sheet is properly held flat when it is gripped by the clips 14. Of course, other means could be devised for producing this flattening action.

Moreover, when the trailing edge of the sheet has been released from clips 14, to prevent these clips from tearing the edge, which is quite possible due to the sudden change of direction of the clip movement in this area where the clips follow a curved course, as shown in FIG. 1, a mechanism is provided for raising the trailing marginal portion of the sheet as it emerges from the heating area, outside the path of clips 14.

This mechanism is illustrated diagrammatically in FIG. 1 and comprises a bent or curved arm 65 secured by means of a block or hub 66 to a rotatable shaft 67. This shaft is coupled in turn to a linkage 68,69,70 adapted to cooperate with a cam 72 rotatably driven in synchronism with the chain sprocket 15 by means of a transmission belt 73. A return spring 74 having one end attached to link 70 and the other end anchored to the frame structure of the machine urges the mutual engagement between the roller follower 71 and cam 72. The contour of cam 72 is so designed that when the trailing edge of a sheet F is released by the clips 14 the linkage 68, 69,70 is moved and assumes the position shown in FIG. 1, in which the bent or curved arm 65 intersects the path of the sheet F and raises suddenly its trailing end, before resuming rapidly its normal position in which it lies beneath this path and extend substantially parallel thereto.

Other means could be devised for producing the same result, for example by directing an air jet from the inner nozzles 6b of hollow rods 6a (see FIG. 1a) substituted for the conventional solid rods 6, or by providing means for causing the clips 14 to recede after the opening thereof.

Figure 7:
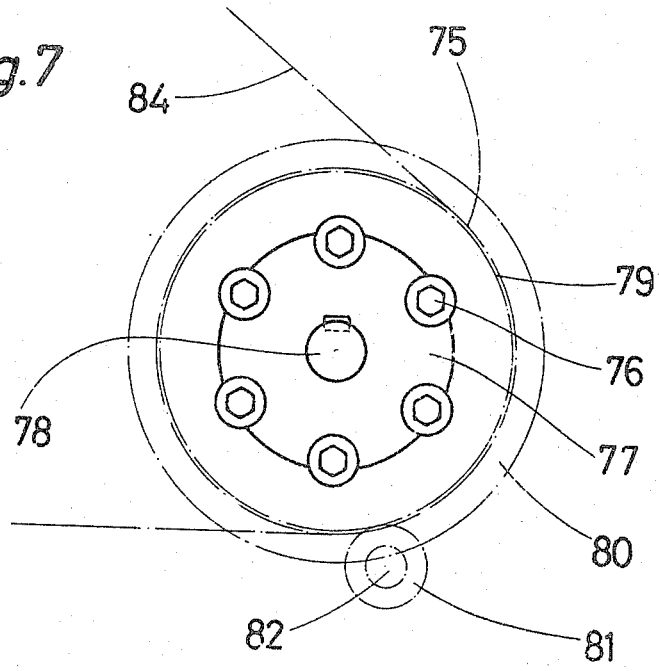
FIG. 7 is a fragmentary diagrammatic view of the means for setting the two systems in relation to each other.
Figure 8:
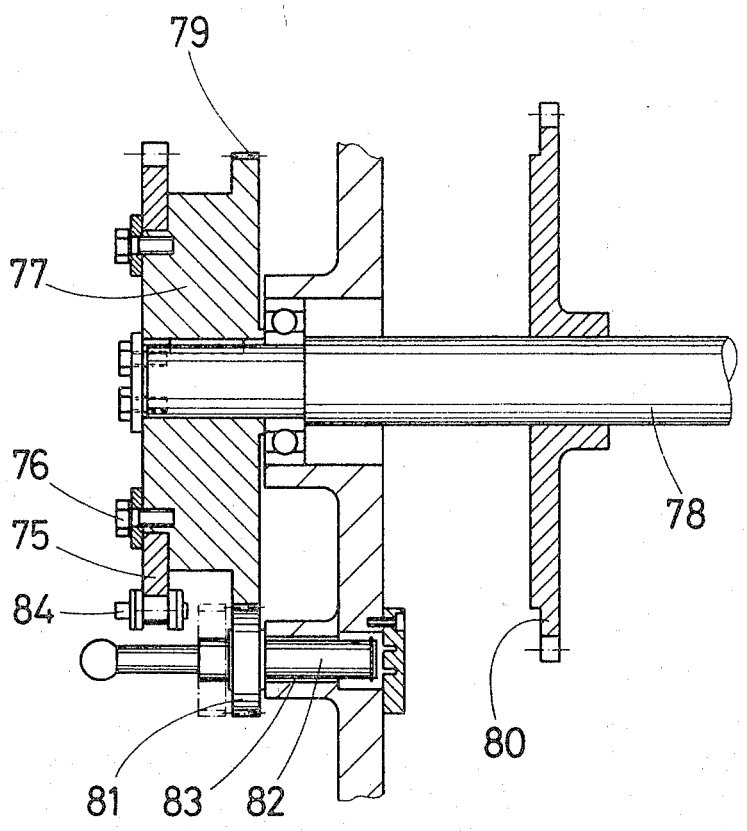
FIG. 8 is a diagrammatic sectional view of the device shown in FIG. 7.

In order to adapt the distance from a series of clips 14 of the second system 11 to the corresponding series of clips 4 of the first system 1 as a function of the sheet length, a particularly simple yet efficient adjustment device shown only in fragmentary view in FIGS. 7 and 8, is provided. This device comprises a first chain sprocket 75 constantly coupled through a roller chain 84 to the first chain-type clip system 1 and consisting of a toothed annulus secured by six screws 76 to the axially protruding hub of a toothed wheel 77 rigid with a shaft 78 belonging to the second chain-type clip system 11, another chain sprocket 80 rigidly mounted on this shaft 78 receiving the roller chain driving this second system 11. With this arrangement, the sprocket 75 and wheel 77 are coaxial to each other and can be set in different angular relative positions by simply removing the aforesaid six screws 76. To this end, mounted on a stub shaft 82 parallel to shaft 78 is a pinion 81 normally urged by a return spring 83 to its non-driving position as shown in FIG. 8, and adapted to be pushed against the force of this spring 83 to a driving position shown in thick lines in the same Figure, in which position its teeth are in meshing engagement with those 79 of toothed wheel 77. Thus, by simply rotating the pinion 81 manually, after removing the screws 76, the operator can rotate the wheel 79,77 with respect to sprocket 75, which means that the second system 11 can be adjusted in relation to the first system 1.

Through the present invention has been described and shown with reference to its application to a device for conveying sheets through a drying area, it should not be construed as being strictly limited to this specific application. Thus, notably, this conveyor system may be used for turning the sheet during their course. In this case, as the sheets emerge from the rectilinear inclined section, their leading edge is released from the clips 4 of the first system and by properly curving the path of the second system of tipping the clips of this second system, which remain closed, the trailing edge of the sheet becomes its leading edge.

Other applications may also be contemplated without departing from the basic principles of the invention.

What is claimed is:

1. A conveyor device for transferring freshly printed sheets from a printing machine to an output stack, which comprises a first system of two parallel endless chains, transverse means extending between said chains for supporting and actuating a series of clips for alternately gripping and releasing the leading edge of the sheet to be transferred, said first endless chain system comprising a predetermined rectilinear section and means for driving the chains continuously, a second system of two parallel endless chains, transverse means extending between said chains for supporting and actuating another series of clips for alternately gripping and releasing the trailing edge of the sheet to be transferred as it enters said rectilinear section, said second system also comprising a predetermined rectilinear section parallel and adjacent to said predetermined rectilinear section of said first system and being driven at the same linear speed as said first section, means for producing a slight backward movement of the clips of said second system with respect to those of the first system for stretching the sheet tautly and keeping the sheet in this condition throughout its travel through said rectilinear section, means mounted on said chains of the second system for supporting the clips thereof in such a way that said clips can be moved in relation to the chains of said second system in the longitudinal direction, said support means being responsive to a control device for movement from a first position in which the sheet is stretched to a second position in which the sheet is slackened and a frame comprising side members secured by means of said side members to the inner faces of the two chains of said second system, said side members comprising guide means for said support means and carrying a rotary shaft rigid with a push-arm and with a control lever provided with a first roller follower, said support means comprising on the one hand a bracket in which a transverse shaft carrying the clips of said second system and a clip actuating lever provided with a second roller follower are rotatably mounted, and on the other hand a plurality of stop members adapted to cooperate with the outer ends of said clips of said second system, and a return spring for urging said support means to said first position in which the sheets are tensioned, said support means being movable as a consequence of an angular movement of said control lever engaging said push-arm against the force of said return spring to said second position, cam means being carried by the frame structure of the device and adapted to actuate said first and second roller followers whereby said clips of said second system are firstly opened before penetrating into said rectilinear section, whereafter said support means is moved to said second position and said clips are reclosed, said support means being moved back to said first position.

2. The conveyor device of claim 1, wherein said support means comprises a pair of spaced lateral walls having each a guide rod secured thereto, said guide rod extending through corresponding bores formed in aligned depending projections formed integrally with said side members of said frame structure and constituting said guide means.

3. The conveyor device of claim 2, wherein said stop members engaged by said clips of said second system in their closed position are secured by means of spring blades to a cross member rigid with said support means.

4. The conveyor device of claim 1, wherein means adapted to hold the trailing edge of the sheet in the normal plane of transfer are provided at the location where said trailing edge is gripped by the clips of said second chain clips system, said holding means consisting of suction orifices formed through the walls of sheet-supporting hollow rods, conduit means being also provided for connecting said orifices to a vacuum source.

5. The conveyor device of claim 4, wherein said rectilinear section of the system is a drying section intended for drying printed sheets, said drying section being free of any sheet supporting members, the arrangement being such that when the sheet emerges from this drying section the clips of the second system of chain clips release the trailing edge of the sheet.

6. The conveyor device of claim 5, wherein at the location where the clips of said second system release the sheet subsequent to the passage of said sheet through said drying section, means are provided whereby, when said trailing edge has been released, the rear portion of the sheet is suddenly lifted off the conveyor plane and consequently outside the reach of said clips.

7. The conveyor device of claim 6, wherein said means for lifting the rear portion of the sheet consist of nozzles through which compressed air is blown.

8. The conveyor device of claim 6, wherein said means for lifting the rear portion of the sheet comprise at least one lever located beneath the sheet transfer plane and responsive through linkage means to a cam adapted to cause said lever to move across said conveyor plane.

9. The conveyor device of claim 8 wherein said drying section comprises an ultraviolet lamp.

10. The conveyor device of claim 8 wherein the drying section comprises an infrared lamp.

11. The conveyor device of claim 1, which comprises a chain sprocket associated with said first system of two parallel endless chains provided with clips, and a toothed wheel rigid with a shaft pertaining to said second system of two parallel endless chains provided with clips, said sprocket and toothed wheel being mounted coaxially and rigidly assembled by means of screws whereby when said screws are removed, the wheel of the second system can be adjusted angularly with respect to the sprocket of the first system, so that the clips of this second system can be adjusted with respect to the clips of the first system.

12. The conveyor device of claim 11, wherein said toothed wheel comprises a circular coaxial shoulder acting as a hub for fitting said sprocket, and said shaft is secured to the another sprocket engaged by the chain of the second system, a stub shaft parallel to said shaft being rigid with a pinion adapted to slide axially against the force of a return spring from an inoperative or non-driving position to an operative position in which said pinion is in meshing engagement with said toothed wheel for causing said toothed wheel to revolve with said second system.

* * * * *